US008172523B2

(12) United States Patent
Towsley et al.

(10) Patent No.: US 8,172,523 B2
(45) Date of Patent: May 8, 2012

(54) MULTISTAGE PUMP ASSEMBLY HAVING REMOVABLE CARTRIDGE

(75) Inventors: Greg Towsley, Lenexa, KS (US); Ryan Haack, Lawrence, KS (US); Joshua Talley, Lawrence, KS (US); Svend Amdisen, Olathe, KS (US)

(73) Assignee: Grudfos Pumps Corporation, Olathe, KS (US)

( * ) Notice: Subject to any disclaimer, the term of this patent is extended or adjusted under 35 U.S.C. 154(b) by 570 days.

(21) Appl. No.: 12/436,534

(22) Filed: May 6, 2009

(65) Prior Publication Data

US 2009/0214332 A1 Aug. 27, 2009

Related U.S. Application Data

(63) Continuation-in-part of application No. 11/868,860, filed on Oct. 8, 2007, now Pat. No. 7,946,810.

(60) Provisional application No. 60/850,871, filed on Oct. 10, 2006.

(51) Int. Cl.
*F01D 1/02* (2006.01)

(52) U.S. Cl. ..... 415/198.1; 415/199.1; 415/203; 415/204

(58) Field of Classification Search ..... 415/99, 415/100, 101, 103, 198.1, 199.1, 204, 206, 415/203

See application file for complete search history.

(56) References Cited

U.S. PATENT DOCUMENTS

| | | | | |
|---|---|---|---|---|
| 2,753,807 | A * | 7/1956 | Lung | 415/199.2 |
| 3,841,791 | A | 10/1974 | Doolin | |
| 4,025,225 | A * | 5/1977 | Durant | 415/90 |
| 4,098,558 | A | 7/1978 | Bush et al. | |
| 4,116,583 | A | 9/1978 | Budris | |
| 4,190,395 | A | 2/1980 | Bali | |
| 4,244,675 | A | 1/1981 | Bower | |
| 4,305,214 | A | 12/1981 | Hurst | |
| 4,421,456 | A | 12/1983 | Huffman | |
| 4,479,756 | A | 10/1984 | Sieghartner | |
| 4,669,956 | A | 6/1987 | Brunel et al. | |
| 4,676,717 | A | 6/1987 | Willyard, Jr. et al. | |
| 4,789,301 | A | 12/1988 | Osborne et al. | |
| 4,842,480 | A * | 6/1989 | Jensen et al. | 415/199.1 |
| 4,877,372 | A | 10/1989 | Jensen et al. | |
| 4,900,224 | A | 2/1990 | Timperi et al. | |

(Continued)

FOREIGN PATENT DOCUMENTS

EP 0 726 397 A1 8/1996

(Continued)

*Primary Examiner* — Igor Kershteyn

(74) *Attorney, Agent, or Firm* — The Small Patent Law Group LLP

(57) ABSTRACT

A multistage pump assembly includes a manifold having an inlet port configured to be coupled to a supply pipe and an outlet port configured to be coupled to a discharge pipe. The inlet and outlet ports define an end suction, radial outlet port configuration. The pump assembly also includes a cartridge having a sleeve and plurality of pumping stages that define a pump stack received within the sleeve. An outer chamber is defined between the pump stack and the sleeve. Each of the pumping stages includes an impeller mounted along a pump shaft that rotates about a rotation axis. The cartridge is aligned horizontally such that the rotation axis is substantially horizontal. An end plate is positioned between the manifold and the cartridge and includes at least one cartridge engagement surface supporting the cartridge. The end plate is removably coupled to the manifold.

30 Claims, 6 Drawing Sheets

U.S. PATENT DOCUMENTS

| | | | |
|---|---|---|---|
| 4,923,367 | A | 5/1990 | Zimmer |
| 4,930,996 | A | 6/1990 | Jensen et al. |
| 5,006,053 | A | 4/1991 | Seno |
| 5,040,946 | A | 8/1991 | Caoduro |
| 5,201,633 | A | 4/1993 | Peu |
| 5,302,091 | A | 4/1994 | Horiuchi |
| 5,336,048 | A | 8/1994 | Ganzon et al. |
| 5,407,323 | A | 4/1995 | Gay et al. |
| 5,478,215 | A | 12/1995 | Kobayashi et al. |
| 5,494,403 | A | 2/1996 | Kobayashi et al. |
| 5,599,164 | A | 2/1997 | Murray |
| 5,601,419 | A | 2/1997 | Kobayashi et al. |
| 5,676,528 | A | 10/1997 | Kobayashi et al. |
| 5,704,768 | A | 1/1998 | Kobayashi et al. |
| 5,752,803 | A | 5/1998 | Wetzel et al. |
| 5,755,554 | A | 5/1998 | Ryali |
| 5,797,731 | A | 8/1998 | Kobayashi et al. |
| 5,846,052 | A | 12/1998 | Kameda |
| 5,873,697 | A | 2/1999 | Gully |
| 5,888,053 | A | 3/1999 | Kobayashi et al. |
| 5,906,479 | A | 5/1999 | Hawes |
| 5,913,657 | A | 6/1999 | Mollenhauer |
| 5,961,301 | A | 10/1999 | Wasserman et al. |
| 5,993,151 | A | 11/1999 | Paulsen et al. |
| 6,082,960 | A | 7/2000 | Fandrey et al. |
| 6,116,851 | A | 9/2000 | Oklejas, Jr. |
| 6,126,392 | A | 10/2000 | Sabini |
| 6,135,723 | A | 10/2000 | Hatton |
| 6,190,119 | B1 | 2/2001 | Roth et al. |
| 6,196,813 | B1 | 3/2001 | Turley et al. |
| 6,203,294 | B1 | 3/2001 | Turley et al. |
| 6,227,796 | B1 | 5/2001 | Markovitch |
| 6,227,802 | B1 | 5/2001 | Torgerson et al. |
| 6,361,280 | B1 | 3/2002 | Fumas |
| 6,398,493 | B1 | 6/2002 | Chien et al. |
| 6,422,838 | B1 | 7/2002 | Sloteman et al. |
| 6,439,835 | B1 | 8/2002 | Chien et al. |
| 6,551,058 | B2 | 4/2003 | Nowack |
| 6,648,606 | B2 | 11/2003 | Sabini et al. |
| 6,776,584 | B2 | 8/2004 | Sabini et al. |
| 6,779,974 | B2 | 8/2004 | Chien |
| 6,799,943 | B2 | 10/2004 | Racer et al. |
| 6,918,307 | B2 | 7/2005 | Ohlsson et al. |
| 7,104,766 | B2 | 9/2006 | Mascola |
| 7,117,120 | B2 | 10/2006 | Beck et al. |
| 7,296,981 | B2 | 11/2007 | Strong |
| 2001/0036404 | A1 | 11/2001 | Nagaoka et al. |
| 2005/0093246 | A1 | 5/2005 | Dietle et al. |
| 2005/0095150 | A1 | 5/2005 | Leone et al. |
| 2005/0147505 | A1 | 7/2005 | Kuroiwa et al. |
| 2006/0127232 | A1 | 6/2006 | Urban et al. |
| 2006/0269404 | A1 | 11/2006 | Volk |

FOREIGN PATENT DOCUMENTS

| | | |
|---|---|---|
| EP | 1 431 584 A2 | 6/2006 |
| WO | WO 92/18776 | 10/1992 |
| WO | WO 98/34030 | 2/1998 |

* cited by examiner

MULTISTAGE PUMP ASSEMBLY HAVING REMOVABLE CARTRIDGE

CROSS-REFERENCE TO RELATED APPLICATIONS

This application is a continuation-in-part of U.S. application Ser. No. 11/868,860, filed Oct. 8, 2007, which claims the benefit of U.S. Provisional Application No. 60/850,871 filed Oct. 10, 2006, the complete subject matter of both of which are expressly incorporated herein by reference in their entirety.

BACKGROUND OF THE INVENTION

The subject matter herein relates generally to pump assemblies, and more particularly, to multistage pump assemblies having removable cartridges.

Pump assemblies are provided within pipe systems of residential, commercial or industrial facilities for increasing the pressure and flow of the fluid within the pipe system. The pump assembly is usually fitted to the pipe system to circulate the fluid under pressure. The typical pump assembly has an inlet that supplies fluid to the pump through a manifold having an impeller chamber, an impeller located in the chamber, a power head (e.g. motor and shaft) to drive the impeller, and an outlet that returns the fluid to the pipe system. The inlet is fitted to a supply pipe and the outlet is fitted to a discharge pipe. The size of the pump assembly is selected based on the particular pipe system and the desired pressure and flow of the fluid within the pipe system. For example, various pump assembly components may be provided to accommodate various sized supply pipes and discharge pipes, which are typically different than one another. The particular pump assembly components chosen depend on the particular application. In another example, in applications where a high pressure is desired, a pump assembly having a relatively larger motor or a relatively larger impeller may be used. In some known pump assemblies, multiple impellers are used, such as in a multistage pump assembly.

The multistage pump assemblies typically have one of two configurations, namely a horizontal configuration and a vertical configuration. In both configurations, the pump assemblies typically stack the multiple impellers in stages in series. In the horizontal configuration, the stack is oriented generally horizontally when installed; and in the vertical configuration, the stack is oriented generally vertically when installed.

In a typical horizontal configuration, the manifold having the inlet is positioned at one end of the stack and the outlet is positioned within a pump head at the opposite end of the stack. These types of pump assemblies include a motor shaft being supported by a shaft bearing within the motor. The impellers are directly coupled to the motor shaft. A drawback with this type of configuration is the number of stages that may be used is limited, due to the drive capacity of motor and the weight of the shaft and the impellers on the shaft bearing. Additionally, this design is complicated to manufacture and assemble. Additionally, repair and/or replacement of the pump stack and/or pump head is difficult and requires that the majority of the pump assembly (e.g. the manifold, each stage, and the pump head) be completely disassembled for servicing.

A need remains for a pump assembly, operable in a horizontal configuration, that can be assembled in a cost effective and reliable manner. A need remains for a pump assembly that may be serviced or replaced in an efficient manner.

BRIEF DESCRIPTION OF THE INVENTION

In one embodiment, a multistage pump assembly is provided including a manifold having an inlet port configured to be coupled to a supply pipe and a outlet port configured to be coupled to a discharge pipe. The inlet and outlet ports define an end suction, radial outlet port configuration. The pump assembly also includes a cartridge having a sleeve and plurality of pumping stages that define a pump stack received within the sleeve. An outer chamber is defined between the pump stack and the sleeve. Each of the pumping stages includes an impeller mounted along a pump shaft that rotates about a rotation axis. The cartridge is aligned horizontally such that the rotation axis is substantially horizontal. An end plate is positioned between the manifold and the cartridge and includes at least one cartridge engagement surface supporting the cartridge. The end plate is removably coupled to the manifold.

Optionally, the end plate may be coupled to the cartridge to form a pump unit, with the pump unit being removable from the manifold. The assembly may include a pump head positioned at an end of the cartridge opposite to the end plate, with the pump head being coupled to the end plate by fasteners with the cartridge captured therebetween. The cartridge may be coupled to the manifold by the end plate. The sleeve and pump stack may engage corresponding contact engaging surfaces of the end plate such that the end plate controls the relative position of the pump stack with respect to the sleeve. Optionally, the end plate may include a shaft support having a bearing for supporting the pump shaft. The manifold may include a suction chamber receiving flow from the inlet port and a discharge chamber expelling flow to the outlet port, where the suction chamber and discharge chamber are axially aligned with one another, and the discharge chamber is radially split around the suction chamber. The cartridge may be sealed against the end plate and the end plate may be sealed against the manifold.

In another embodiment, a multistage pump assembly is provided including a manifold having an inlet port configured to be coupled to a supply pipe and a outlet port configured to be coupled to a discharge pipe, and including a cartridge having a sleeve and plurality of pumping stages defining a pump stack received within the sleeve. An outer chamber is defined between the pump stack and the sleeve, and each pumping stage includes an impeller mounted along a pump shaft rotating along a rotation axis. The pump stack extends between a first end and a second end, with the first end having an end wall with an opening therethrough providing a flow path to a first pumping stage. The cartridge is aligned horizontally such that the rotation axis is substantially horizontal. The assembly also includes an end plate positioned between the manifold and the cartridge, with the end plate including an outer cartridge engagement surface supporting the sleeve and an inner cartridge engagement surface supporting the end wall of the first end of the pump stack.

In a further embodiment, a method is provided of servicing a horizontal multistage pump assembly that includes a manifold and a pump unit at least partially received in the manifold. The method includes removing the pump unit from the manifold by decoupling the pump unit from the manifold and then servicing the pump unit at a remote location from the manifold by repairing or replacing all or a subset of the components of the pump unit. The method further includes loading the pump unit into the manifold, wherein the pump unit loaded into the manifold includes a cartridge and an end plate positioned at the end of the cartridge between the cartridge and the manifold. The cartridge has a pump stack that includes a horizontally extending pump shaft supported at a distal end by either the end plate or the manifold. The pump unit is loaded into the manifold with the end plate supporting the pump stack during loading into the manifold.

In yet another embodiment, a pump family of multistage pump assemblies is provided that includes a manifold having an inlet port configured to be coupled to a supply pipe and a outlet port configured to be coupled to a discharge pipe, where the inlet and outlet ports defining an end suction, radial outlet port configuration and where the manifold has a mating interface. The pump family includes a first pump unit including a cartridge and an end plate positioned at a mating end of the cartridge. The cartridge has a sleeve and a pump stack received within the sleeve. The pump stack has pumping stages configured to produce a relative low pressure and a horizontally extending pump shaft that rotates about a rotation axis. The pump family also includes a second pump unit including a cartridge and an end plate positioned at a mating end of the cartridge, with the cartridge having a sleeve and a pump stack received within the sleeve. The pump stack has pumping stages configured to produce a relative high pressure and a horizontally extending pump shaft that rotates about a rotation axis. The first and second pump units are configured to be separately coupled to the manifold with the first pump unit coupled to the manifold to provide the relative low pressure and the second pump unit coupled to the manifold to provide the relative high pressure.

DETAILED DESCRIPTION OF THE INVENTION

Figure 1:
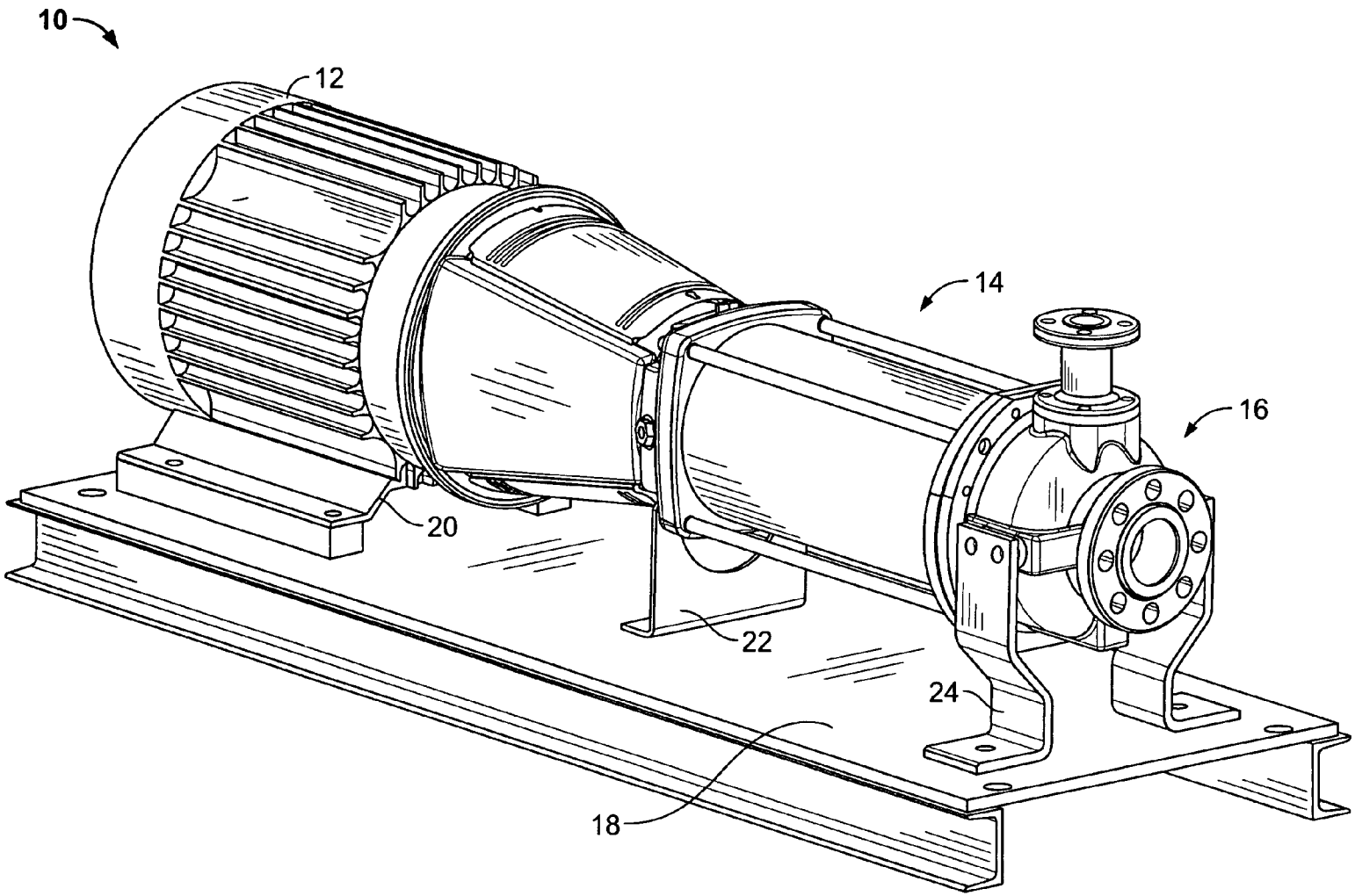
FIG. 1 is a side perspective view of a pump assembly formed in accordance with an exemplary embodiment.

FIG. 1 is a side perspective view of a pump assembly 10 formed in accordance with an exemplary embodiment. The pump assembly 10 includes a pump motor 12, a cartridge 15 coupled to the pump motor 12 and a volute 16 coupled to the cartridge 15. The pump assembly 10 may be installed in an existing or new pipe system to a supply pipe and a discharge pipe (not shown) for increasing the pressure and/or flow of water or another fluid within the pipe system. In the illustrated embodiment, the pump assembly 10 represents a horizontal pump assembly that may be mounted to a base 18 via a plurality of supports or braces, such as motor supports 20, a pump stack support 22, and volute supports 24. The base 18 is generally planar and is oriented horizontally, and may be mounted, directly or indirectly to a ground or building surface (not shown). While various embodiments of horizontal pump assemblies are described below, it is understood that the pump assembly 10 may be beneficial in other, non-horizontal applications as well. The following embodiments are therefore provided for illustrative purposes only.

Figure 2:
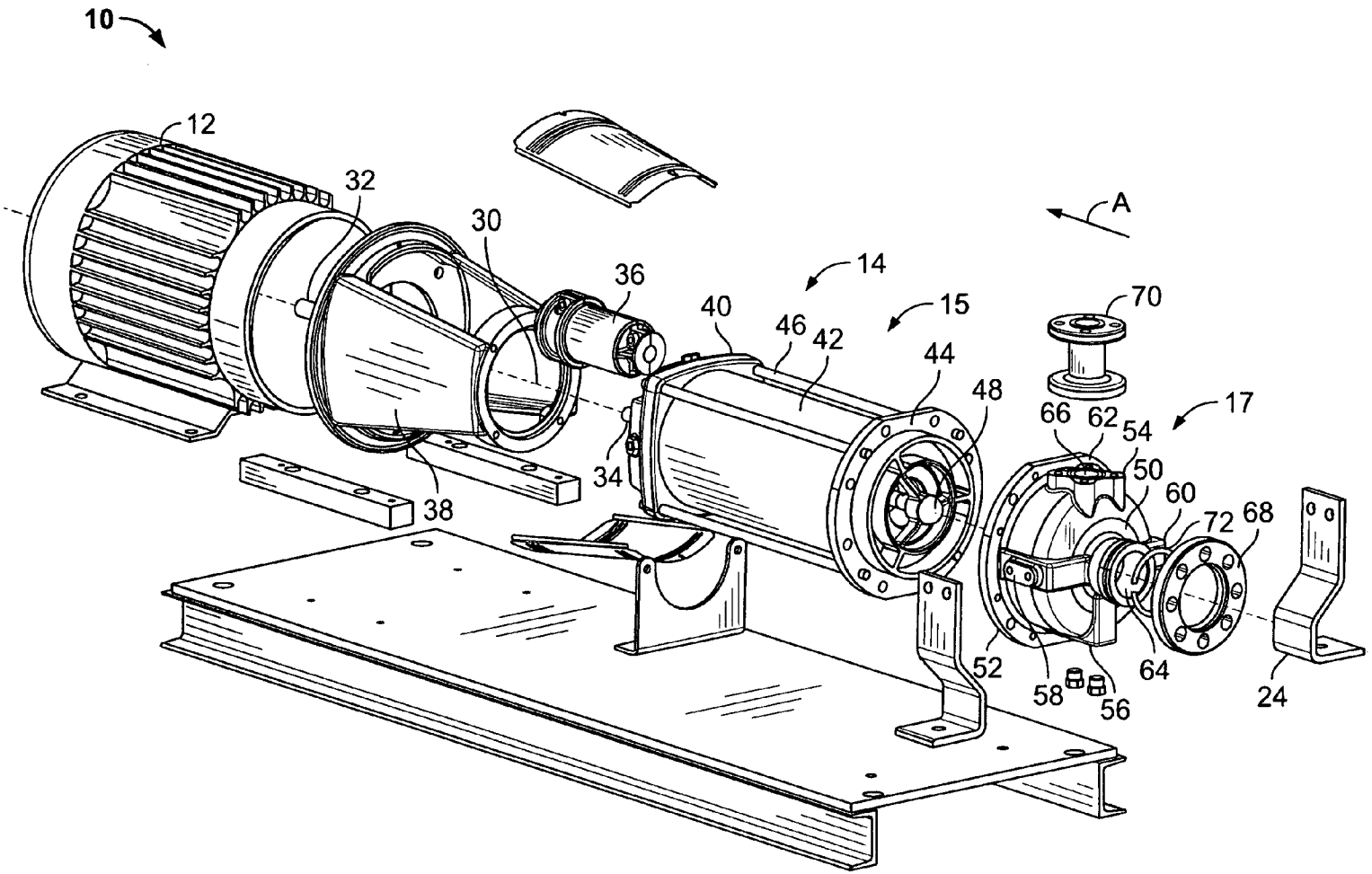
FIG. 2 is an exploded view of the pump assembly shown in FIG. 1.

FIG. 2 is an exploded view of the pump assembly 10, illustrating the motor 12, the cartridge 15 and the volute 16 being axially aligned with one another along a longitudinal or rotation axis 30. The cartridge 15 includes a multistage pump stack 14 having a plurality of pumping stages 86 (shown in FIG. 3) of impeller assemblies and diffusers.

The motor 12 includes a motor shaft 32 aligned with the rotation axis 30, and the pump stack 14 includes a pump shaft 34 aligned with the rotation axis 30. The motor shaft 32 and the pump shaft 34 are interconnected by a shaft coupling 36 for transmitting torque from the motor shaft 32 to the pump shaft 34. The shaft coupling 36 is housed within an enclosure 38 extending between the motor 12 and the cartridge 15.

The cartridge 15 defines a pump unit that includes the pump stack 14, a pump head 40, a sleeve 42 and an end plate 44. The sleeve 42 surrounds the pump stack 14. The pump stack 14 and the sleeve 42 generally extend between the pump head 40 and the end plate 44. In the illustrated embodiment, the end plate 44 is represented by a sleeve flange and may be referred to hereinafter as sleeve flange 44, however the end plate 44 may have different shapes, components and configurations in alternative embodiments. The end plate 44 is arranged at a first end of the cartridge 15 and the pump head 40 is arranged at a second end of the cartridge 15. The pump stack 14, sleeve 42, end plate 44 and pump head 40 are secured together to define a pump unit that may be physically handled and transferred as a single unit. As such, the cartridge 15 is self-contained or otherwise assembled together and may be removed from the volute 16 and/or the motor 12 as a single unit for servicing or repair. For example, the end plate 44 may be decoupled from the volute 16 and the cartridge 15 removed. The end plate 44 operates to hold the sleeve 42 and the pumping stages 86 of the pump stack 14 together relative to one another for removal. The cartridge 15 may be held together sufficient enough to allow the components of the cartridge 15 to be transported together, where the relative positions of the components of the cartridge 15 are substantially maintained.

The sleeve 42 has a generally circular cross section and defines a chamber through which the fluid flows. In the illustrated embodiment, and as will be explained in greater detail below, the cartridge 15 includes an inner chamber and an outer chamber through which the fluid is channeled. The sleeve 42 defines a radially outer surface of the outer chamber. The sleeve flange 44 is separately provided from, and coupled to, the sleeve 42. The sleeve flange 44 is retained in place with respect to the sleeve 42 and the pump head 40 by multiple staybolts 46 extending between the pump head 40 and the sleeve flange 44. The pump shaft 34 extends through the pump stack 14 and is substantially centered within the chamber defined by the sleeve 42. Optionally, an end of the pump shaft 34 may be supported by a bearing support 48 integrated with the sleeve flange 44.

The volute 16 is one type of manifold that may be coupled to a supply pipe and a discharge pipe of a pipe system, and may be referred to hereinafter as a manifold 17. The volute 16 directs fluid flow from the supply pipe to the cartridge 15 and from the cartridge 15 to the discharge pipe. The volute 16 includes a front end 50, a rear end 52, a top 54, a bottom 56, and sides 58 and 60. The volute supports 24 may be coupled to the sides 58, 60 using known fasteners or known fastening methods. The volute 16 is coupled to the sleeve flange 44 via a volute flange 62 extending radially outward at the rear end 52 of the volute 16, such as using known fasteners and known fastening methods. The volute 16 is coupled to the sleeve flange 44 such that the volute 16 is in fluid communication with the cartridge 15. As such, the sleeve flange 44 is positioned between the volute 16 and the pump stack 14. Optionally, the cartridge 15 may be sealed against one side of the sleeve flange 44 and the volute 16 may be sealed against the other side of the sleeve flange 44.

In the illustrated embodiment, the volute 16 represents an end-suction volute having an inlet 64 at the front end 50 and an outlet 66 at the top 54. The inlet and outlet 64, 66 may define ports through which fluid flows from respective supply and discharge pipes. The inlet 64 and the outlet 66 are non-parallel with respect to one another, such that the volute 16 has a non-in-line configuration (e.g. an orientation in which the inlet and the outlet are not aligned with one another along an axis). Optionally, the inlet 64 and the outlet 66 may be generally perpendicular with respect to one another, such as the end-suction, 90 degree discharge configuration illustrated in FIG. 2. Optionally, the inlet 64 is oriented in-line with the rotation axis 30 such that the fluid flows through the inlet 64, the volute 16, the sleeve flange 44 and the pump stack 14 in a direction along the rotation axis 30, shown by the arrow A. Other configurations and orientations of the inlet and outlet 64 and 66 are contemplated in alternative embodiments, such as on the front end 50, top 54, bottom 56 or sides 58, 60 in a non-in-line configuration.

In the illustrated embodiment, the volute 16 includes an inlet fitting 68 and an outlet fitting 70 coupled to the inlet 64 and outlet 66, respectively. The fittings 68, 70 are separately provided from the volute 16 and mountable thereto. The fittings 68, 70 may be securely coupled to the volute 16 using known fasteners or fastening methods. For example, the fittings 68, 70 may be threadably coupled to the volute 16; the fittings 68, 70 may be coupled to the volute 16 using integral flanges and corresponding fasteners; the fittings 68, 70 may be soldered or welded to the volute 16; and the like. The fittings 68, 70 are also configured for attachment to the supply and discharge pipes, respectively, such as by a flange coupling, a threaded coupling, a soldered coupling, and the like. The type and size of fitting 68, 70 (e.g. flange, threaded, and the like) may be selected based on the type of mating fitting included on the supply and discharge pipes. A modular volute 16 is thus provided that may be adapted for installation to an existing piping system. Optionally, the types of fittings 68, 70 may be the same and/or the size of the opening of the fittings 68, 70 may be the same. Alternatively, the type and/or size of the fittings 68, 70 may be different than one another. In the illustrated embodiment, the outlet fitting 70 constitutes a modular discharge spool having first and second flanges at the ends thereof. Multiple discharge spools may be provided with the pump assembly 10, wherein each spool has different dimensions, such as opening size, flange size, height, width, length, thickness, fitting type, and the like. The discharge spools are interchangeable with the volute 16 to accommodate a range of discharge pipe configurations. In the illustrated embodiment, the inlet fitting 68 constitutes a victaulic connection using a snap ring 72 and corresponding grooves on each of the inlet fitting 68 and the volute 16 at the inlet 64. The inlet fitting 68 also includes a flange for interconnection with the supply pipe, however, other types of interconnection may be accomplished in lieu of the flange coupling. Optionally, multiple fittings may be provided with the pump assembly 10, wherein each fitting has different dimensions, such as opening size, flange size, height, width, length, thickness, fitting type, and the like. The multiple fittings are interchangeable with the volute 16 to accommodate a range of supply pipe configurations. In alternative embodiments, other connecting methods and devices may be employed, such as a threaded coupling, a welded or soldered coupling, and the like. Optionally, seals may be positioned between the fittings 68, 70 and the volute 16 to seal the interconnection therebetween. In alternative embodiments, the fittings 68, 70 may be integrally formed with the volute 16 and positioned for interconnection with the supply and discharge pipes.

Figure 3:
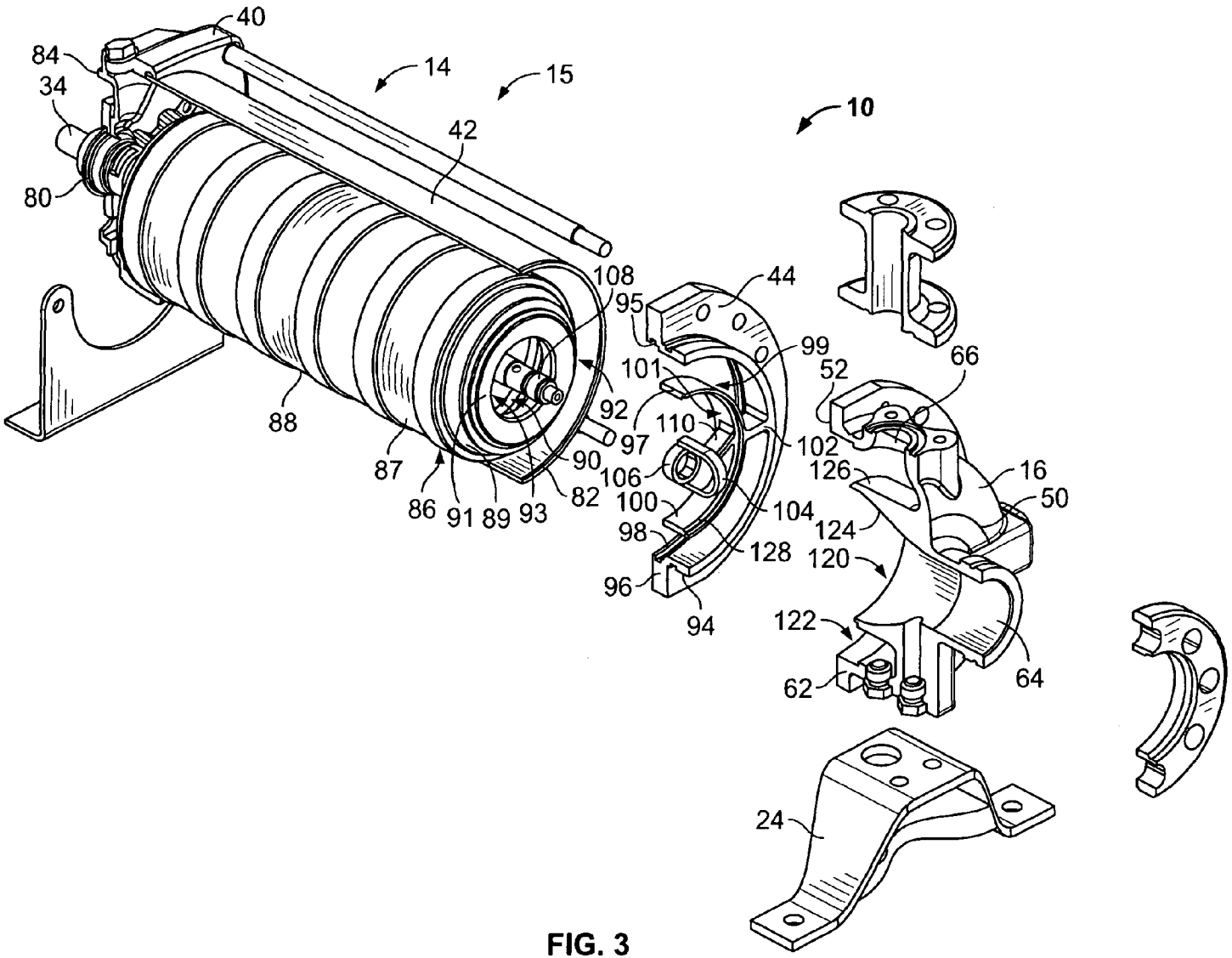
FIG. 3 is a partial cutaway view of the pump assembly shown in FIG. 2.

FIG. 3 is an exploded, partial cutaway view of the pump assembly 10 illustrating the pump head 40, the sleeve 42, the sleeve flange 44 and the volute 16 being cutaway. As illustrated in FIG. 3, the cartridge 15 includes a seal cartridge 80 located between the pump head 40 and the pump shaft 34. The seal cartridge 80 seals against fluid leakage from the cartridge 15 at the pump head 40. The pump shaft 34 is rotatable within the seal cartridge 80 and the seal cartridge 80 operates to seal the fluid from escaping from the cartridge 15.

The pump stack 14 extends from a first end 82 to a second end 84 and includes multiple pumping stages 86 between the first and second ends 82, 84. Any number of stages may be provided depending on the particular application and the desired flow rate or pressure of the pump assembly 10. The first end 82 is located proximate the volute 16, and in the exemplary embodiment, the sleeve flange 44 is coupled to the first end 82. The second end 84 is located proximate the pump head 40, and in the exemplary embodiment, the pump head 40 defines the second end 84. The pumping stages 86 each include an impeller (not shown) therein that is coupled to the pump shaft 34. The impeller rotates to channel the fluid through the corresponding stage. Optionally, each pumping stage 86 includes a diffuser 87 shaped to force the fluid from an upstream stage to a downstream stage as the fluid is pumped from the first end 82 to the second end 84. Each stage includes a single impeller and a single diffuser 87. Additionally, the first pumping stage 86 includes a diffuser represented by suction interconnector 89 at the upstream end of the first stage. The suction interconnector 89 is sized to interconnect the sleeve flange 44 and the downstream diffusers 87. In the illustrated embodiment, the pump stack 14 includes an end wall 91. The end wall 91 includes an opening 93 therethrough providing a flow path to a first of the pumping stages. The end wall 91 engages and is supported by the sleeve flange 44 once assembled. The end wall 91 includes a necked down portion having a reduced diameter at the end thereof for joining with the sleeve flange 44. Optionally, at least one of the stages may constitute a bearing stage that includes a bearing for supporting the pump shaft 34. Such bearing stages are used more often in longer pump stacks 14.

The pumping stages 86 include an outer surface 88 spaced radially outward from the pump shaft 34 and spaced radially inward from the sleeve 42. A suction, or radially inward, chamber 90 is positioned between the outer surface 88 of the pumping stages 86 and the pump shaft 34. The impellers are positioned within the suction chamber 90. A discharge, or radially outward, chamber 92 is positioned between the outer surface 88 of the pumping stages 86 and the sleeve 42. The suction and discharge chambers 90, 92 are axially aligned, but radially split or spaced with respect to one another. The suction chamber 90 is in fluid communication with, and extends between the inlet 64 of the volute 16 and the discharge chamber 92, and the discharge chamber 92 is in fluid communication with, and extends between the suction chamber 90 and the outlet 66 of the volute 16.

As described above, the sleeve flange 44 is located at the first end 82 of the pump stack 14. The sleeve flange 44 includes an outer surface or outer ring 94, from which a flange portion 96 of the sleeve flange 44 extends. The volute flange 62 is coupled to the flange portion 96 during assembly of the pump assembly 10. The outer surface 94 has a substantially circular cross section and is sized substantially the same as the sleeve 42. Optionally, the outer surface 94 includes an outer cartridge engagement surface 95, and a portion of the cartridge 15, such as the sleeve 42, engages the outer cartridge engagement surface 95. The sleeve flange holds the vertical position of the sleeve 42 with respect to the downward, gravitational forces on the sleeve 42. The outer surface 94 defines an extension of the sleeve 42 wherein an end of the outer surface 94 abuts the first end 82 of the sleeve 42 and continues upstream from the sleeve 42. Alternatively, the outer surface 94 may be slightly larger than the sleeve 42 such that the sleeve 42 may fit within the outer surface 94 in sealing engagement. Optionally, a seal (not shown) may be positioned between the outer surface 94 and the sleeve 42 for sealing the connection therebetween. The seal and/or the sleeve 42 may be received within an annular groove 98 in the outer surface 96. Optionally, the annular groove 98 is positioned at a rear end of the sleeve flange 44.

The sleeve flange 44 further includes a concentric ring 100 positioned radially inward with respect to the outer surface 94. The ring 100 defines an inner cartridge engagement surface 97, and a portion of the cartridge 15, such as the end wall 91, engages the inner cartridge engagement surface 97. Optionally, a seal may be provided between the engagement surface 97 and the cartridge 15. The concentric ring 100 is positioned to separate water flowing within the suction chamber 90 from water flowing within the discharge chamber 92. Optionally, the concentric ring 100 operates as an extension of the outer surface 88 of the pumping stages 86. The concentric ring 100 is supported and positioned by braces 102 extending between the concentric ring 100 and the outer surface 94. The ring 100 holds the vertical position of the pump stack 14 to be centered within the sleeve 42. The ring 100 controls the relative position of the pump stack 14 with respect to the sleeve 42. An inner annulus 99 is defined radially inward of the ring 100. An outer annulus 101 is defined between the ring 100 and the outer surface 94. The inner annulus 99 connects the opening 93 and suction chamber 90 with an inner chamber 120 of the volute 16. The outer annulus 101 connects the outer or discharge chamber 92 with an outer chamber 122 of the volute 16. As such, the sleeve flange 44 defines two flow paths.

Optionally, the sleeve flange 44 may include a bearing support 104 at a central portion of the sleeve flange 44. The bearing support 104 includes a mating bearing 106 that engages with a corresponding mating bearing 108 of the pump shaft 34. The bearing support 104 operates to support the mating bearings 106, 108 and the pump shaft 34. The bearing support 104 is supported by braces 110 extending between the concentric ring 100 and the bearing support 104.

The volute 16 includes the inner chamber 120 and the outer chamber 122. The inner chamber 120 is in fluid communication with the inlet 64 and the outer chamber 122 is in fluid communication with the outlet 66. The inner chamber 120 extends between the inlet and the concentric ring 100 of the sleeve flange 44, and restricts fluid flow directly between the inlet 64 and the outlet 66. In the illustrated embodiment, the inner chamber 120 is axially aligned with the inlet 64 and the suction chamber 90 of the pump stack 14 and extends axially along the rotation axis 30. The inner chamber 120 channels all of the fluid entering the inlet 64 to the suction chamber 90 via the sleeve flange 44. Optionally, the inner chamber 120 includes a transition section 124 that changes size from the upstream end to the downstream end. In the illustrated embodiment, the transition section 124 increases in diameter from the upstream end to the downstream end. The diameter of the inner chamber 120 is substantially equal to the diameter of the concentric ring 100. Optionally, registers 126 and 128 are provided on each of the concentric ring 100 and the volute 16 at the rear end 52 where the volute 16 is joined to the sleeve flange 44. The register 128 of the sleeve flange 44 defines an inner engagement surface that engages and is sealed against the volute 16. The outer surface 94 of the sleeve flange 44 defines an outer engagement surface that engages and is sealed against the volute 16.

The outer chamber 122 extends between the front end 50 and the rear end 52 of the volute 16. The outer chamber 122 is positioned radially outward with respect to the inner chamber 120, and completely surrounds the inner chamber 120. The outer chamber 122 is axially aligned with the outer chamber 92 of the cartridge 15 and receives fluid therefrom and directs the fluid to the outlet 66.

In the embodiment of FIG. 3, the volute support 24 is represented by a bottom support at the bottom 56 of the volute 16.

An exemplary operation of the pump assembly 10 will be described below with reference to FIGS. 1-3. In operation, water or another fluid enters the volute 16 at the inlet 64 via the inlet fitting 68 from the supply pipe. In the illustrated embodiment, the fluid flows axially through the inlet 64 and through the volute 16 to the pump stack 14. Between the inlet 62 and the outlet 64, the fluid is pumped through the multistage pump stack 14, wherein the pressure of the fluid is increased based on the number of stages within the pump stack 14 at a given rotational speed. Within the pump stack 14, the fluid initially passes through the suction interconnector 89 of the first, or upstream, stage of the pump stack 14. The suction interconnector 89 defines the upstream end of the suction chamber 90. The fluid is channeled by the suction interconnector 89 and/or the diffuser 87 into a bottom runner or impeller of the first pump stage, and the impeller forces the fluid to the diffuser 87 of the first stage. The diffuser 87 of the first stage channels the fluid into the impeller of the second stage. Correspondingly, a plurality of stages may be arranged one after another depending on the pressure differential required. For example, any number of pump stages may be selected depending on the particular outlet fluid requirements, such as flow, pressure, and the like, and sleeves 42 of various lengths may be provided to accommodate the chosen number of pump stages. The staybolts 46 may also be sized accordingly to hold the pump unit together. Optionally, the pump assembly 10 may include a single stage.

In accordance with one embodiment, a pump family may be provided with pump units having a different number of stages. For example, a first pump unit may have M number of pumping stages and a second pump unit may have N number of pumping stages that is greater than the M number of pumping stages of the first pump unit. Any one of the pump units may be alternatively, separately coupled to a common manifold depending on the water demand at the discharge of the pump. Additionally, if the water demand changes, the pump unit may be changed thereby increasing or decreasing the number of pumping stages associated with the manifold to accommodate the fluid demand of the particular application. Given that each pump unit is capable of fitting with the same manifold, a pump family is provided that has a modular design that increases efficiency, such as by reducing part count and/or by reducing assembly time. Additionally, the pump family may include multiple different sized manifolds, wherein all or a subset of a plurality of pump units are configured to mate with each manifold.

Once the fluid is forced through the last pump stage, the fluid is conveyed to the discharge chamber 92. The fluid is channeled through the discharge chamber 92 to the outer chamber 122 of the volute 16. The outer surface 88 of the pumping stages 86 separates and isolates the inner and outer chambers 90, 92. Similarly, the concentric ring 100 separates or isolates the fluid flowing between the inner chambers 90, 120 from the fluid flowing between the outer chambers 92, 122. The fluid within the annular space of the outer chamber 122 of the volute 16 is expelled from the volute 16 through the outlet 66 and into the discharge pipe.

In an exemplary embodiment, as described above, the cartridge 15 is removable from the volute 16, such as for servicing the cartridge 15. For example, the service may include repairing or replacing some or all of the components of the cartridge 15. The volute 16 is coupled to the supply and discharge pipes. When the cartridge 15 is removed, the volute 16 may remain connected to the supply and discharge pipes. As such, servicing of the pump assembly 10 may be accomplished more quickly. For removal, fasteners connecting the end plate 44 to the volute 16 may be removed, and the pump unit (e.g. end plate 44, sleeve 42 pump head 40 and pump stack 14) may be de-coupled from the volute 16. During servicing, the sleeve 42 may be removed and the pumping stages exposed. Any number of the pumping stages may be repaired or replaced and the pump unit reassembled. The pump unit, or a new pump unit, may then be re-coupled to the volute 16. The pump unit may or may not have the same number of pumping stages.

During de-coupling and re-coupling, the end plate 44 is used to hold the pumping stages in place as a pump unit. The end plate 44 also holds the pump shaft 34 in position with respect to the pumping stages and/or the sleeve 42. Additionally, when a new pump unit is re-coupled to the volute 16, the new pump unit may have a different configuration, such as shape, size or diameter as the pump unit being replaced. When a pump unit having a different size or shape is re-coupled to the volute 16, the end plate 44 used may have a mating end for mating with the volute 16 that is substantially the same as the end plate of the old pump unit such that the same volute 16 may be used and different types and/or sizes of end plates 44 may be attached to the same volute 16.

During de-coupling, the end plate 44 and pump shaft 34 are moved away from the volute 16 in a horizontal, axial direction, such as along the rotation axis 30, at least until the pump unit clears the volute 16. The pump unit may then be turned generally vertically for servicing so that each of the pumping stages may rest directly upon one another. During re-coupling, the end plate 44 and pump shaft 34 are moved toward the volute 16 in a horizontal, axial direction, such as along the rotation axis 30, until the end plate 44 is loaded into the volute 16. The pump shaft 34 and pump stack 14 are held horizontally by the end plate 44 such that the pump shaft 34 and pump stack 14 may be properly vertically positioned with respect to the volute 16 so as to not obstruct assembly.

Figure 4:
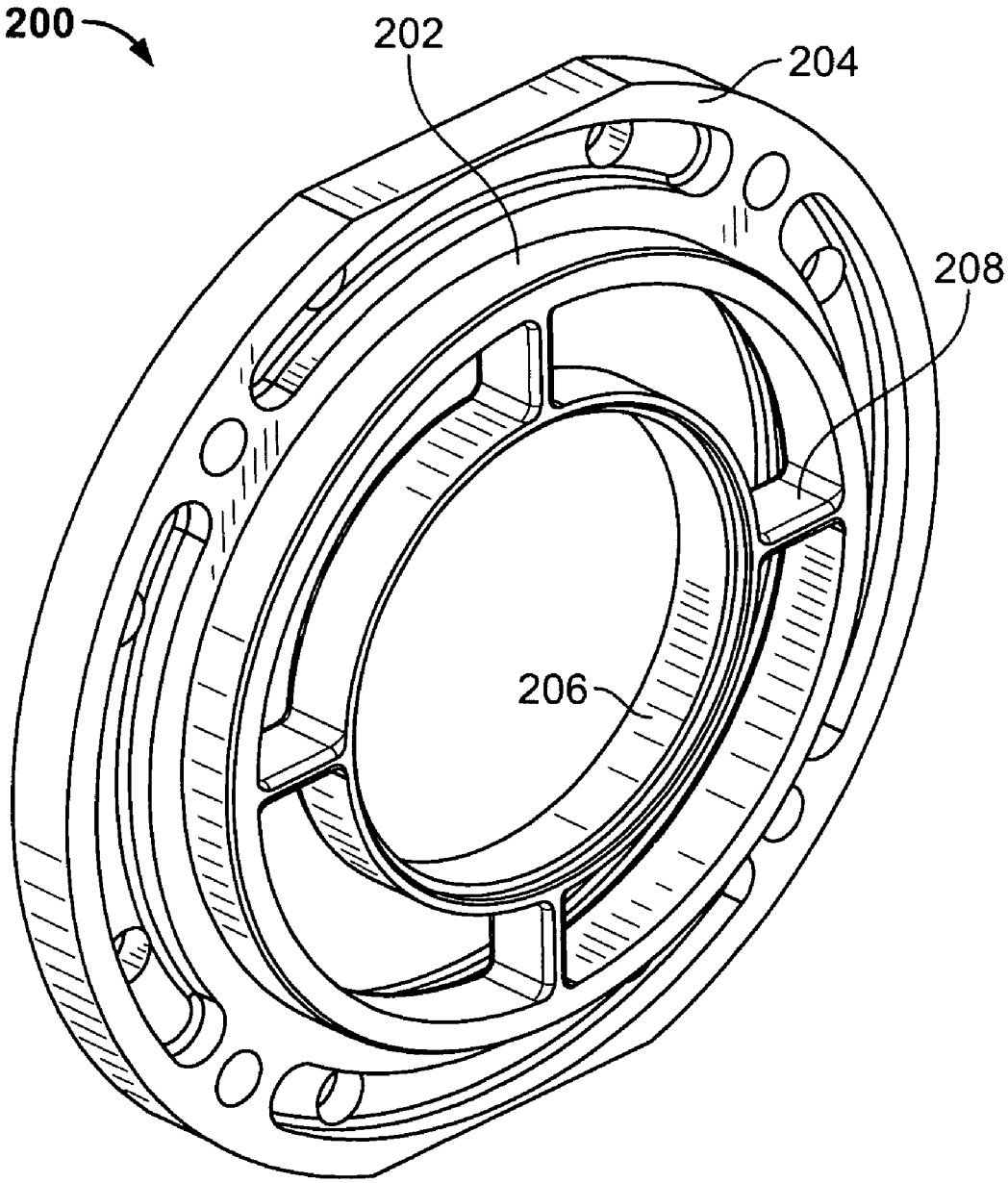
FIG. 4 is a side perspective view of an alternative sleeve flange for the pump assembly shown in FIG. 1.

FIG. 4 is a side perspective view of an alternative end plate in the form of a sleeve flange 200 for the pump assembly 10 and formed in accordance with an alternative embodiment. The sleeve flange 200 includes an outer surface 202, from which a flange portion 204 of the sleeve flange 200 extends. The outer surface 202 is dimensioned to interface with the sleeve 42 and the volute 16 (both shown in FIG. 3) in a similar manner as the sleeve flange 44 described above. The sleeve flange 200 further includes a concentric ring 206 positioned radially inward with respect to the outer surface 202. The concentric ring 206 is dimensioned and positioned to interface with the cartridge 15 and the volute 16 in a similar manner as the sleeve flange 44 described above. The concentric ring 206 is supported and positioned by braces 208 extending between the concentric ring 206 and the outer surface 202. The sleeve flange 200 does not include a bearing support. The sleeve flange 200 is open radially inward from the concentric ring 206 and fluid is able to flow unobstructed therethrough.

Figure 5:
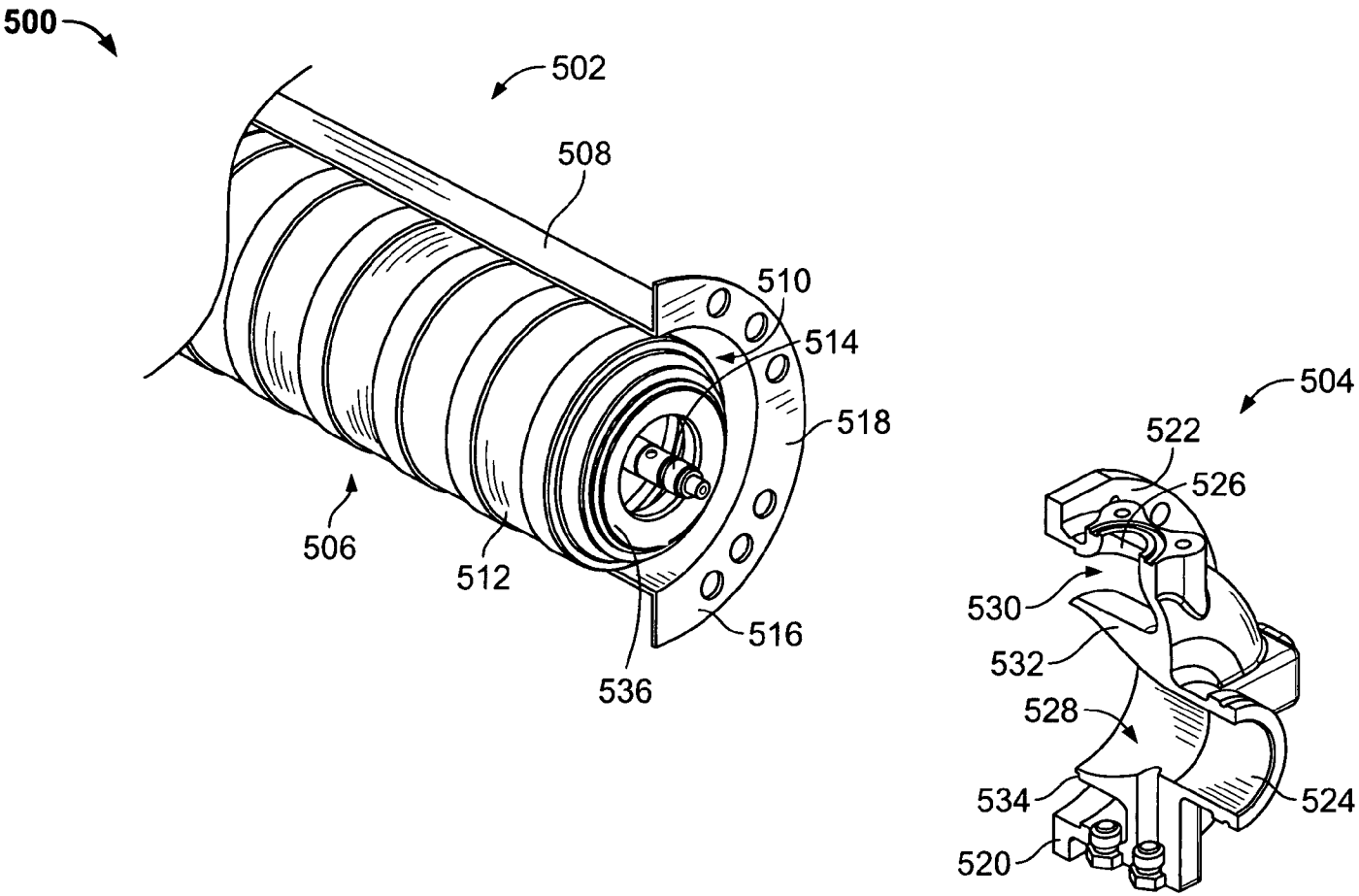
FIG. 5 illustrates an alternative pump assembly having a sleeve with an integral end plate formed in accordance with an exemplary embodiment.

FIG. 5 illustrates a portion of an alternative pump assembly 500 formed in accordance with an exemplary embodiment. The pump assembly 500 includes a cartridge 502 and a manifold 504. The cartridge 502 includes a pump stack 506 similar to the pump stack 14 illustrated in FIGS. 1-3. The cartridge 502 also includes a sleeve 508 surrounding the pump stack 506. An outer chamber 510 is formed between the pump stack 506 and the sleeve 508. The pump stack 506 includes a plurality of pumping stages 512 and a pump shaft 514. The pump assembly 500 includes an end plate 516. Rather than being separately provided from and positioned between the cartridge 502 and manifold 504, the end plate 516 is integrally formed with the sleeve 508. The end plate 516 includes a flange 518 extending radially outward from the sleeve 508. The flange 518 is configured to be coupled to the manifold 504.

The manifold 504 includes a mating end 520 configured to be coupled to the cartridge 502. The manifold 504 includes a flange 522 that is coupled to the flange 518. The manifold 504 includes an inlet 524 and an outlet 526. The inlet and outlet 524, 526 may define ports through which fluid flows from respective supply and discharge pipes. The manifold 504 includes an inner chamber 528 in fluid communication with the inlet 524 and an outer chamber 530 in fluid communication with the outlet 526. An inner wall 532 separates the inner and outer chambers 528, 530. In an exemplary embodiment, the inner wall 532 includes a cartridge engagement surface 534 supporting the cartridge 502. For example, the cartridge engagement surface 534 engages an end wall 536 of the pump stack 506. Optionally, the manifold 504 may includes a bearing support (not shown) to support an end of the pump shaft 514. Alternatively, the pump shaft 514 may be cantilevered and supported by the motor.

In an alternative embodiment, rather than the manifold 504 supporting the pump stack 506, the end plate 516 may include a support (not shown) extending radially inward. The support may be arranged to engage the end of the pump stack 506 to support the pump stack 506. The support may also include a bearing support for supporting the pump shaft 514. The support may be integrally formed with the sleeve 508 and the end plate 516. For example, the support may be formed from a common piece of sheet metal as the sleeve 508 and the end plate 516. The support may be welded or other wise secured to the sleeve 508 and/or the end plate 516.

In an exemplary embodiment, the cartridge 502 and the end plate 516 may be removed from the manifold 504 as a pump unit. The end plate 516 holds the pumping stages in position relative to the sleeve 508. As such, the pump stack 506 may be easily handled during de-coupling and re-coupling with the manifold 504.

Figure 6:
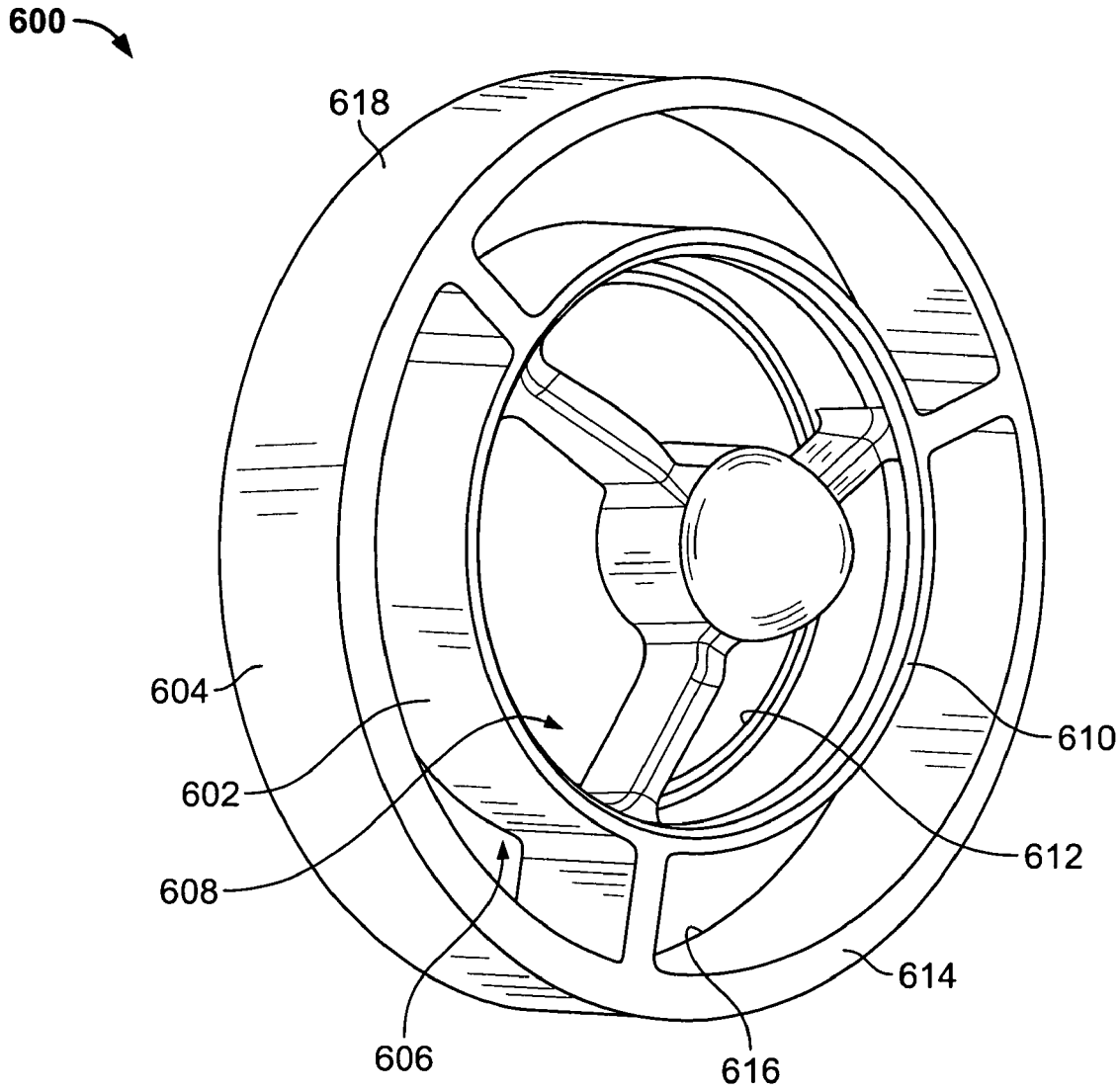
FIG. 6 illustrates an alternative pump assembly having an alternative end plate.

FIG. 6 illustrates an alternative end plate 600 for the pump assembly 10 (shown in FIG. 1). The end plate 600 includes a first ring 602 and a second ring 604 concentrically surrounding the first ring 602. A first annulus or chamber 606 is formed between the first and second rings 602, 604. A second annulus or chamber 608 is formed inside the first ring 602. The first ring 602 is sized to engage the manifold 16 (shown in FIG. 1) and/or the cartridge 15. For example, the first ring 602 may include first and second engagement surfaces 610, 612 that engage the manifold 16 and cartridge 15, respectively. The second ring 604 is sized to engage the manifold 16 and/or the cartridge 15. For example, the second ring 604 may include first and second engagement surfaces 614, 616 that engage the manifold 16 and the cartridge 15, respectively. The second ring 604 may include an outer surface 618 defining an outer perimeter of the end plate 600. The outer surface 618 is sized to fit within the sleeve 42 (shown in FIG. 2). The end plate 600 may be held within the sleeve 42, such as by a friction fit, and supports the pump stack 14 (shown in FIG. 1) relative to the sleeve 42. In an exemplary embodiment, the end plate 600 holds the pumping stages in position relative to the sleeve 42. As such, the pump stack 14 may be easily handled during de-coupling and re-coupling with the manifold 16.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A multistage pump assembly comprising:

a manifold having an inlet port configured to be coupled to a supply pipe and a outlet port configured to be coupled to a discharge pipe, the inlet and outlet ports defining an end suction, radial outlet port configuration;

a cartridge having a sleeve and having a plurality of pumping stages that define a pump stack received within the sleeve, an outer chamber being defined between the pump stack and the sleeve, each of the pumping stages include an impeller mounted along a pump shaft that rotates about a rotation axis, the cartridge being aligned horizontally such that the rotation axis is substantially horizontal; and an end plate positioned between the manifold and the cartridge, the end plate including at least one cartridge engagement surface supporting the cartridge, the end plate being removably coupled to the manifold.

2. The assembly of claim 1, wherein the end plate is coupled to the cartridge to form a pump unit, the pump unit being removable from the manifold.

3. The assembly of claim 1, further comprising a pump head positioned at an end of the cartridge opposite to the end plate, the pump head being coupled to the end plate by fasteners with the cartridge captured therebetween.

4. The assembly of claim 1, wherein the cartridge is coupled to the manifold by the end plate.

5. The assembly of claim 1, wherein the sleeve and pump stack engage corresponding contact engaging surfaces of the end plate such that the end plate controls the relative position of the pump stack with respect to the sleeve.

6. The assembly of claim 1, wherein the end plate includes a shaft support having a bearing for supporting the pump shaft.

7. The assembly of claim 1, wherein the manifold includes a suction chamber receiving flow from the inlet port and a discharge chamber expelling flow to the outlet port, the suction chamber and discharge chamber being axially aligned with one another, and the discharge chamber being radially split around the suction chamber.

8. The assembly of claim 1, wherein the cartridge is sealed against the end plate and the end plate is sealed against the manifold.

9. The assembly of claim 1, wherein the end plate separates the cartridge from the manifold.

10. The assembly of claim 1, wherein the inlet port extends along the axis of rotation such that flow passes straight through the manifold and end plate to the pump stack.

11. The assembly of claim 1, wherein the end plate includes a flange extending radially outward around an outer portion of the end plate, the flange extending beyond the sleeve and being coupled to the manifold.

12. The assembly of claim 1, wherein the end plate is integrally formed with the cartridge.

13. A multistage pump assembly comprising:

a manifold having an inlet port configured to be coupled to a supply pipe and a outlet port configured to be coupled to a discharge pipe;

a cartridge having a sleeve and plurality of pumping stages defining a pump stack received within the sleeve, an outer chamber being defined between the pump stack and the sleeve, each pumping stage including an impeller mounted along a pump shaft rotating along a rotation axis, the pump stack extending between a first end and a second end, the first end having an end wall with an opening therethrough providing a flow path to a first pumping stage, the cartridge being aligned horizontally such that the rotation axis is substantially horizontal; and an end plate positioned between the manifold and the cartridge, the end plate including an outer cartridge engagement surface supporting the sleeve and an inner cartridge engagement surface supporting the end wall of the first end of the pump stack.

14. The assembly of claim 13, wherein the end plate includes a first ring and a second ring concentrically surrounding the first ring, the first ring being positioned proximate the opening in the end wall of the pump stack.

15. The assembly of claim 13, wherein the end plate includes a first end and a second end, the first end being sealed against the manifold and the second end being sealed against the end plate.

16. The assembly of claim 13, wherein the end plate includes an inner annulus and an outer annulus, the inner annulus connecting the suction chamber of the manifold with the opening in the end wall of the pump stack, and the outer annulus connecting the outer chamber of the cartridge with the discharge chamber of the manifold.

17. The assembly of claim 13, wherein the end plate holds a vertical position of the pump stack substantially centered with respect to the vertical position of the sleeve.

18. The assembly of claim 13, wherein the end plate is coupled to the cartridge to form a pump unit, the pump unit being removable from the manifold.

19. The assembly of claim 13, wherein the inlet port extends along the axis of rotation such that flow passes straight through the manifold and end plate to the opening in the pump stack.

20. The assembly of claim 13, further comprising a pump head positioned at an end of the cartridge opposite to the end plate, the pump head being coupled to the end plate by fasteners with the cartridge captured therebetween.

21. A method of servicing a horizontal multistage pump assembly that includes a manifold and a pump unit at least partially received in the manifold, the method comprising:

removing the pump unit from the manifold by decoupling the pump unit from the manifold;

servicing the pump unit at a remote location from the manifold by repairing or replacing all or a subset of the components of the pump unit; and loading the pump unit into the manifold, wherein the pump unit loaded into the manifold includes a cartridge and an end plate positioned at the end of the cartridge between the cartridge and the manifold, the cartridge having a pump stack that includes a horizontally extending pump shaft supported at a distal end by either the end plate or the manifold, wherein the pump unit is loaded into the manifold with the end plate supporting the pump stack during loading into the manifold.

22. The method of claim 21, wherein removing the pump unit includes moving the pump unit in a horizontal, axial direction away from the manifold, and wherein loading the pump unit includes aligning the pump unit with the manifold and moving the pump unit in a horizontal axial direction toward the manifold.

23. The method of claim 21, wherein servicing the pump unit includes repairing or replacing at least one pump stage of the pump stack.

24. The method of claim 21, wherein servicing the pump unit includes replacing the pump unit with a different pump unit.

25. The method of claim 21, wherein the end plate includes a flange, the method further comprising:

uncoupling the flange from the manifold prior to removing the pump unit; and coupling the flange to the manifold after the pump unit is loaded into the manifold.

26. A pump family of multistage pump assemblies comprising:

a manifold having an inlet port configured to be coupled to a supply pipe and a outlet port configured to be coupled to a discharge pipe, the inlet and outlet ports defining an end suction, radial outlet port configuration, the manifold having a mating interface;

a first pump unit including a first cartridge and a first end plate positioned at a first mating end of the first cartridge, the first cartridge having a first sleeve and a first pump stack received within the first sleeve, the first pump stack having first pumping stages configured to produce a relative low pressure and the first pump stack having a first horizontally extending pump shaft that rotates about a rotation axis;

and a second pump unit including a second cartridge and a second end plate positioned at a second mating end of the second cartridge, the second cartridge having a second sleeve and a second pump stack received within the second sleeve, the second pump stack having second pumping stages configured to produce a relative high pressure and the second pump stack having a second horizontally extending pump shaft that rotates about a rotation axis;

wherein the first and second pump units are configured to be alternatively coupled to the manifold, the first pump unit coupled to the manifold to provide the relative low pressure and the second pump unit coupled to the manifold to provide the relative high pressure.

27. The pump family of claim 26, wherein the first and second end plates are identically formed.

28. The pump family of claim 26, wherein the first and second end plates have a similar shape but are dimensioned differently.

29. The pump family of claim 26, wherein the first end plate includes a first manifold engagement surface and a first cartridge engagement surface supporting the first cartridge, and the second end plate includes a second manifold engagement surface and a second cartridge engagement surface supporting the second cartridge, wherein the first and second manifold engagement surfaces are identically formed to mate with the mating end of the manifold, the first and second cartridge engagement surfaces of the first and second end plates being either identically formed or differently formed.

30. The pump family of claim 26, wherein the second pump unit includes a greater number of pumping stages than the first pump unit, the first pump unit being removable from the manifold and replaceable with the second pump unit when the pressure demand of the water is increased.

* * * * *